US005787535A

United States Patent [19]

Epstein

[11] Patent Number: 5,787,535

[45] Date of Patent: Aug. 4, 1998

[54] CHAIN SAW MULTI-TOOL

[76] Inventor: David A. Epstein, 18 Summer St., Buzzards Bay, Mass. 02532

[21] Appl. No.: 827,000

[22] Filed: Apr. 14, 1997

[51] Int. Cl.[6] ..... B26B 11/00

[52] U.S. Cl. ..... 7/118; 7/100; 7/168

[58] Field of Search ..... 7/118, 120, 165, 7/167, 168, 100, 138, 177.4, 177.6, 440; 81/490, 437, 439, 177.7, 177.8

[56] References Cited

U.S. PATENT DOCUMENTS

| | | | |
|---|---|---|---|
| 63,171 | 3/1867 | Norton | 7/118 |
| 665,759 | 1/1901 | Schretter | 7/118 |
| 4,578,835 | 4/1986 | Pichler et al. | 7/168 |
| 4,699,030 | 10/1987 | Yang | 7/138 |
| 4,805,250 | 2/1989 | Dugas | 7/118 |
| 5,450,774 | 9/1995 | Chang | 7/168 |
| 5,553,340 | 9/1996 | Brown, Jr. | 7/118 |

FOREIGN PATENT DOCUMENTS

| | | | |
|---|---|---|---|
| 626048 | 5/1927 | France | 7/118 |
| 5845 | 3/1912 | United Kingdom | 7/118 |

*Primary Examiner*—D. S. Meislin
*Assistant Examiner*—Joni B. Danganan
*Attorney, Agent, or Firm*—John P. McGonagle

[57] ABSTRACT

A multi-tool with an assembly of tool instruments particularly useful for the field maintenance of chain saws. The multi-tool includes a hollow handle with a spark plug socket connected at one and a plurality of tool instruments pivotally connected at the end opposite the spark plug socket. The tool instruments include a raker gauge, small tooth file, large tooth file, small screw driver, large screw driver, air filter brush and serrated knife. The tools pivot about the handle end into the hollow handle. Included with the tool is a sliver tweezer which is insertable into an aperture formed within the multi-tool handle. The spark plug socket is pivoted about one end of the multi-tool handle and locked in place in a keyed-portion of the handle, thereby providing a tool acting as a socket wrench capable of applying substantial torque to a work piece, e.g., spark plug.

7 Claims, 4 Drawing Sheets

CHAIN SAW MULTI-TOOL

BACKGROUND OF THE INVENTION

This invention relates to compound tools, and in particular to a combination tool particularly useful for maintaining chain saws under field conditions.

Chain saws used in, for example, logging operations and fighting forest fires require regular and frequent maintenance to keep the saws in efficient operating condition. Under typical conditions a logger or other chain saw user will travel on foot a considerable distance into the forest from his truck or other base of operations, and the saw user must carry the tools and supplies needed to adjust and maintain the saw. These tools typically include, at a minimum, a socket wrench, screw driver, tooth file and raker gauge. Other desirable tools include a knife, sliver tweezer and air filter brush. Keeping up with separate tools and avoiding loss and/or breakage while they are carried is a common problem.

Various types of tool devices are known in the prior art for servicing chain saws. U.S. Pat. Nos. 5,285,543 to Rowe and 3,935,757 to Granberg both disclose combination tools for servicing chain saws. Though useful, the Rowe and Granberg tools do not provide all the tools desirable for field maintenance of chain saws and similar gasoline engine driven tools.

There remains a need for a combination tool including the implements particularly desirable for the field maintenance of chain saws and other gasoline engine driven tools.

SUMMARY OF THE INVENTION

In view of the foregoing disadvantages inherent in the known types of devices now present in the prior art, the present invention provides a multi-tool with an assembly of tools particularly useful for the field maintenance of chain saws. To attain this, the multi-tool of the present invention includes a hollow handle with a spark plug socket connected at one and a plurality of tool instruments pivotally connected at the end opposite the spark plug socket. The tool instruments include a raker gauge, small tooth file, large tooth file, small screw driver, large screw driver, air filter brush and serrated knife. The tools pivot about the handle end into the hollow handle. Included with the tool is a sliver tweezer which is insertable into an aperture formed within the multi-tool handle.

A feature of the present invention is the spark plug socket which is pivoted about one end of the multi-tool handle and locked in place in a keyed-portion of the handle. This feature has the advantage of providing a tool acting as a socket wrench capable of applying substantial torque to a work piece, e.g., spark plug.

This together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1A:
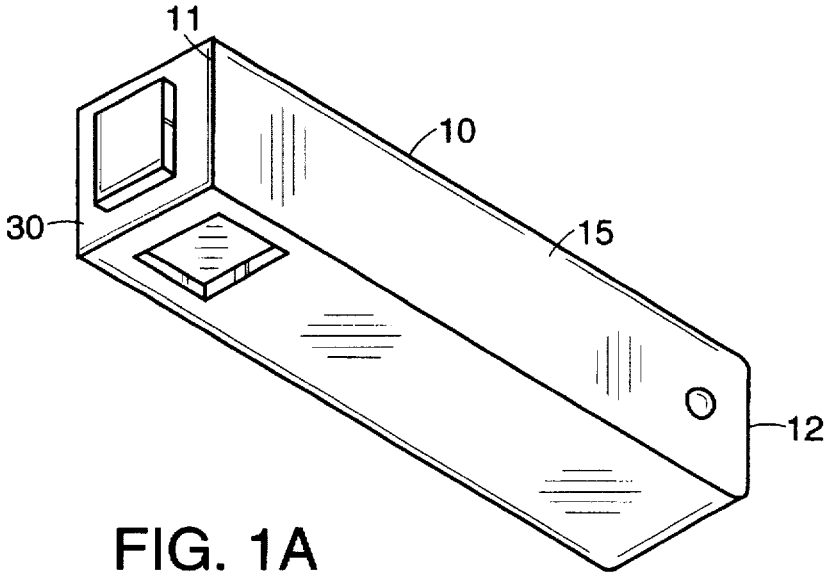
FIG. 1A is a bottom perspective view of the present invention with the socket element stored.
Figure 1B:
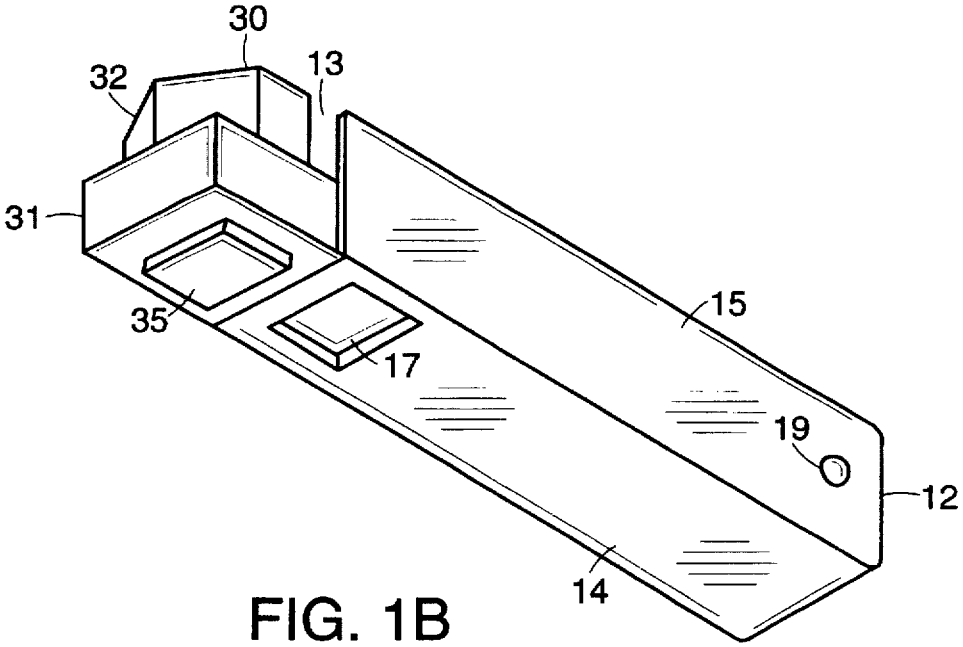
FIG. 1B is a bottom perspective view of the present invention with the socket element deployed.
Figure 2A:
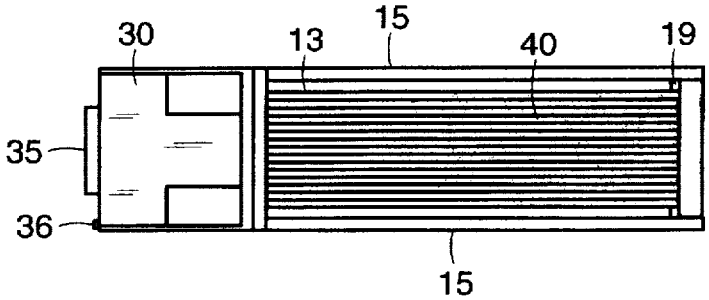
FIG. 2A is a top view of the present invention with the socket element stored.
Figure 2B:
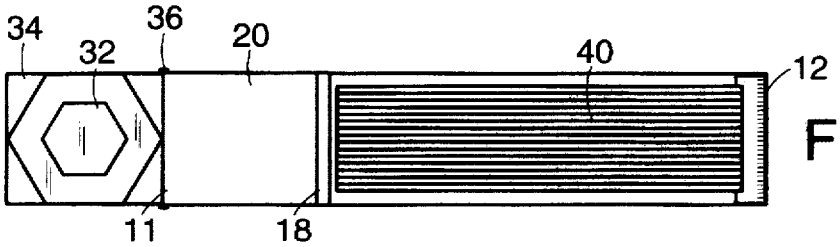
FIG. 2B is a top view of the present invention with the socket element deployed.
Figure 3:
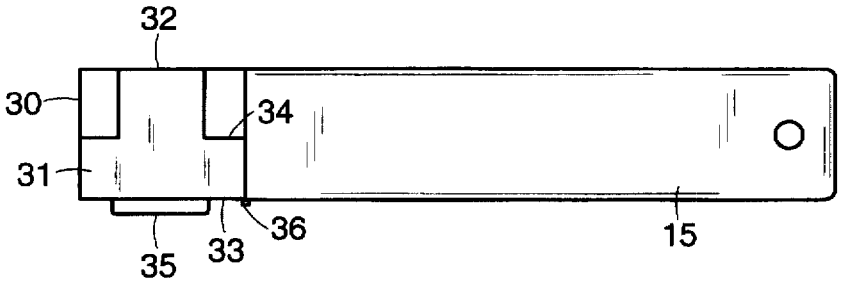
FIG. 3 is a side view thereof.
Figure 4:
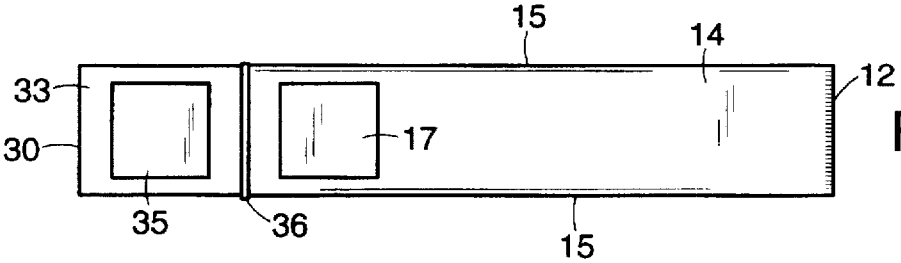
FIG. 4 is a bottom view thereof.
Figure 5:
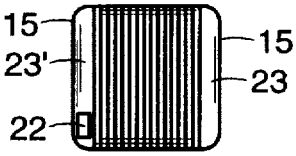
FIG. 5 is an end view thereof.
Figure 6:
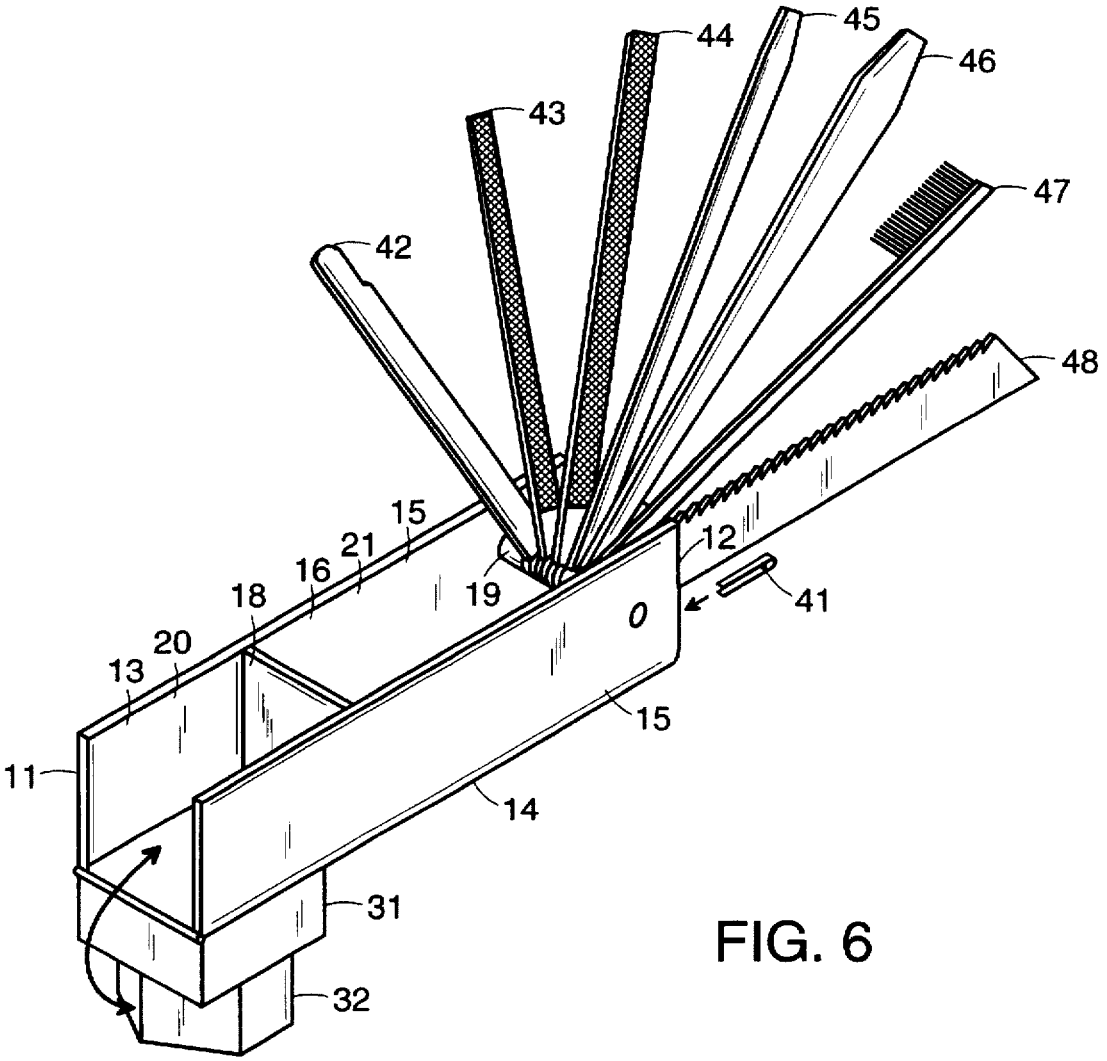
FIG. 6 is a top perspective view of the present invention showing the various instruments deployed according to the present invention.
Figure 7:
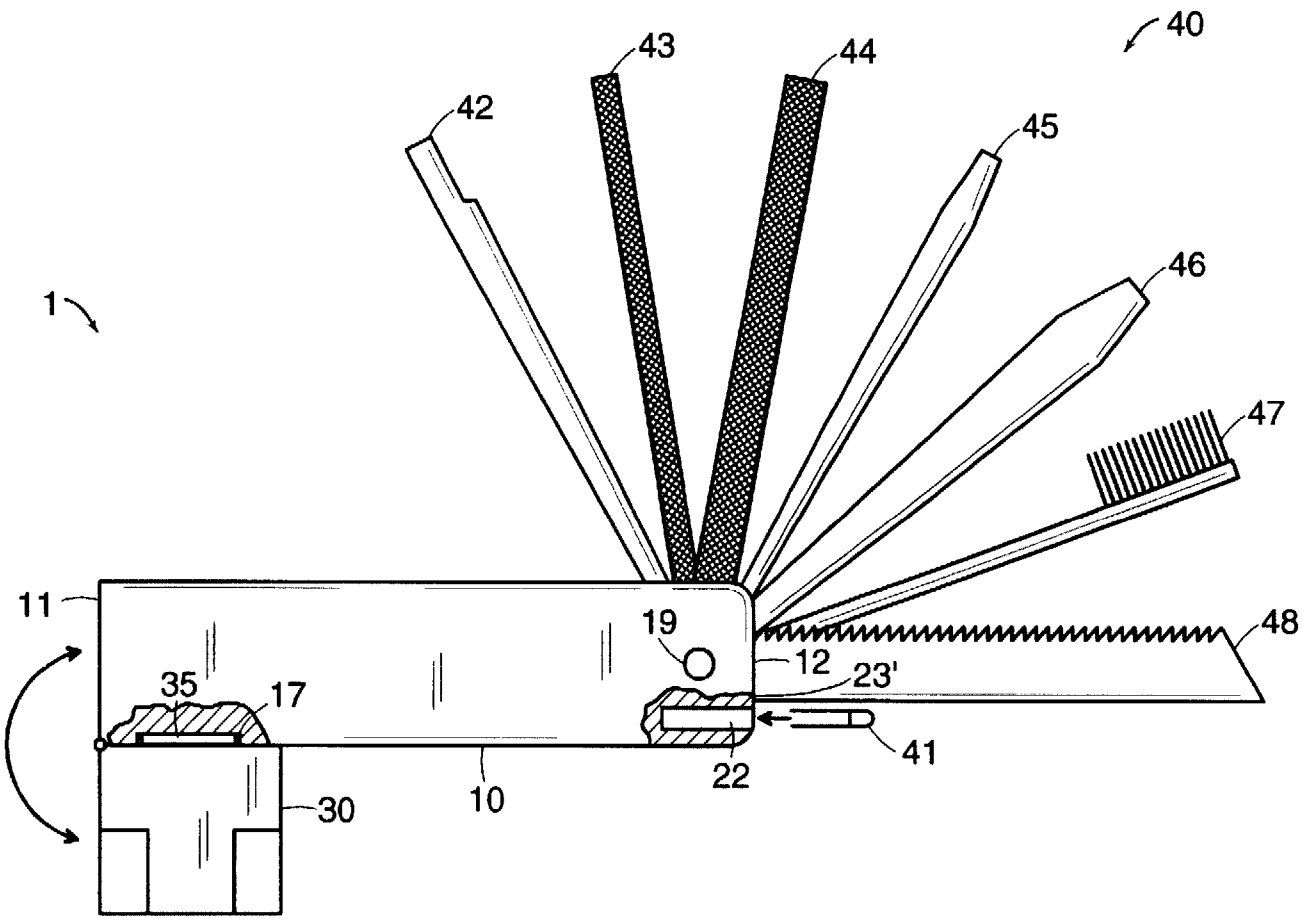
FIG. 7 is a side elevational view thereof.

Referring to the drawings in detail wherein like elements are indicated by like numerals, there is shown a preferred embodiment of the multi-tool of the present invention indicated by reference numeral 1. The multi-tool 1 includes an elongated, generally rectangular hollow handle 10 with two open ends, a first end 11 with a spark plug socket element 30 connected thereto and a second end 12 opposite the first end 11. The handle 10 has a longitudinal axis defined by the two ends 11, 12. The handle 10 has an open top 13, closed bottom 14, and two sides 15, defining a hollow interior 16. The socket element 30 is pivotally attached to the handle bottom 14 at the first end 11. The tool instruments 40 are pivotally attached to a pivot pin 19 positioned in the handle interior 16, connected to the handle sides 15 and located close to the second end 12. The handle bottom 14 contains a rectangular indentation 17 near to the first end 11. The handle interior 16 also contains a wall 18 extending from side-to-side 15, and from bottom 14 to top 13. The plane of the wall 18 is transverse to the longitudinal axis of the handle 10. The wall 18 is positioned approximately one quarter of the longitudinal distance of the handle 10 from first end 11 to second end 12. The wall 18 and first end 11 define a handle interior portion 20 for storing the socket element 30. The wall 18 and second end 12 define a handle interior portion 21 for storing the tool instruments 40.

The socket element 30 is comprised of a generally rectangular base portion 31 and a socket portion 32. The base portion 31 has a rear surface 33 and front surface 34. The base rear surface 33 has a rectangular protrusion 35 formed therein, said protrusion 35 having dimensions slightly less than the dimensions of the handle bottom rectangular indentation 17. The socket portion 32 is formed on the base front surface 34. The socket portion 32 is open and hollow and is adapted to fit over a spark plug (not shown). The socket element 30 has a width slightly less than the interior distance between the handle sides 15. The socket element base portion rear surface 33 has one edge 36 pivotally attached to the handle bottom 14 at the first end 11. The socket element 30 is adapted to be stored within the handle interior portion 20 and to be deployed by pivoting 270° out of the handle interior 20, through the handle first end 11 and around to the handle bottom 14 wherein the socket element protrusion 35 is inserted into the handle bottom indentation 17. The protrusion 35—indentation 17 combination provides a "key" arrangement, whereby the entire handle 10 can be used to apply torque to the socket element 30.

Each handle side 15 has a certain thickness. Each side 15 has an edge 23 terminating at the handle second end 12. One side edge 23' has an elongated aperture 22 formed therein with a longitudinal axis parallel to the longitudinal axis of the handle 10. The aperture 22 is formed in the edge 23' near to the handle bottom 14. The aperture 22 is adapted to receive and store a sliver tweezer 41.

As stated above the present invention provides a number of tool instruments 40 pivotally attached to a pivot pin 19 positioned in the handle interior 16, connected to the handle sides 15 and located close to the second end 12. The tool instruments 40 are pivotally stored within the handle interior portion 21 defined by the wall 18 and the second end 12. The tool instruments 40, jointly and severally, are adapted to be pivoted up to slightly greater than 180° about the pivot pin 19 out of the handle interior storage area 21 through the handle open top 13 and through the handle second end 12. In this embodiment of the invention, the tool instruments 40 are comprised of a raker gauge 42, small tooth file 43, large tooth file 44, small screw driver 45, large screw driver 46, air filter brush 47, and serrated knife 48. The pivot pin 19 is removable so that the tool instruments 40 configuration may be changed and also so that the files 43, 44 may be changed as they are worn out.

It is understood that the above-described embodiment is merely illustrative of the application. Other embodiments may be readily devised by those skilled in the art which will embody the principles of the invention and fall within the spirit and scope thereof.

I claim:

1. A multi-tool with an assembly of tools adapted for the field maintenance of chain saws, comprising:

an elongated, generally rectangular, hollow handle with two open and opposite ends, a first end and a second end, said handle having a longitudinal axis defined by the two said ends, said handle having an open top, closed bottom, and two sides, defining a hollow interior, said handle bottom containing a rectangular indentation near to the first end, each side having an edge terminating at the handle second end;

a spark plug socket element connected to said first end, said socket element being pivotally attached to the handle bottom at the first end, said socket element having a width slightly less than an interior distance between the handle sides, said socket element being comprised of a generally rectangular base portion having a rear surface and a front surface, said base rear surface having a rectangular protrusion formed thereon, said protrusion having dimensions slightly less that the dimensions of the said handle bottom rectangular indentation, and a socket portion formed on the base front surface, said socket portion being open and hollow and adapted to fit over a spark plug;

a plurality of tool instruments pivotally connected to the second end;

a wall in said handle interior, said wall extending from side-to-side, and from bottom to top, said wall lying in a plane transverse to the longitudinal axis of the handle, said wall and first end defining a handle interior portion for storing the said socket element, said wall and second end defining a handle interior portion for storing the said tool instruments; and a pivot pin positioned in the handle interior, connected to the handle sides and located close to the second end, wherein said tool instruments are pivotally attached thereto.

2. A multi-tool as recited in claim 1, wherein:

said socket element base portion rear surface has one edge pivotally attached to the handle bottom at the first end, said socket element being adapted to be stored within the handle interior portion and to be deployed by pivoting out of the handle interior, through the handle first end and around to the handle bottom wherein said socket element protrusion is inserted into the handle bottom indentation, said protrusion—indentation combination providing a "key" arrangement, whereby the entire handle can be used to apply torque to the socket element.

3. A multi-tool as recited in claim 2, further comprising:

an elongated aperture formed on one side edge near to near to the handle bottom at said handle second end, said elongated aperture having a longitudinal axis parallel to the longitudinal axis of the handle, said elongated aperture being adapted to receive and store a sliver tweezer.

4. A multi-tool as recited in claim 3, wherein:

said tool instruments are adapted to being pivotally stored within the handle interior portion defined by the wall and the second end.

5. A multi-tool as recited in claim 4, wherein:

said tool instruments are adapted to being pivoted up to slightly greater than 180° about said pivot pin out of the handle interior storage area through the handle open top and through the handle second end.

6. A multi-tool as recited in claim 5, wherein:

said pivot pin is removable so that the tool instruments configuration may be changed and so that individual tool instruments may be changed.

7. A multi-tool as recited in claim 6, wherein:

said tool instruments are comprised of a raker gauge, small tooth file, large tooth file, small screw driver, large screw driver, air filter brush, and serrated knife.

* * * * *